United States Patent [19]

Skinner

[11] 4,269,159

[45] May 26, 1981

[54] ENGINE SYSTEM

[75] Inventor: Robert T. J. Skinner, High Wycome, England

[73] Assignee: Lucas Industries Limited, Birmingham, England

[21] Appl. No.: 75,193

[22] Filed: Sep. 12, 1979

[30] Foreign Application Priority Data

Oct. 12, 1978 [GB] United Kingdom ..... 40331/78

[51] Int. Cl.[3] ..... F02M 25/06

[52] U.S. Cl. ..... 123/569

[58] Field of Search ..... 123/119 A, 569, 568

[56] References Cited

U.S. PATENT DOCUMENTS

| | | | |
|---|---|---|---|
| 3,916,857 | 4/1975 | Naito et al. | 123/119 A |
| 4,020,809 | 3/1977 | Kern et al. | 123/119 A |
| 4,031,873 | 6/1977 | Banzhaf et al. | 123/119 A |
| 4,043,304 | 8/1977 | Stumpp et al. | 123/119 A |
| 4,120,214 | 10/1978 | Toda et al. | 123/119 A |
| 4,143,631 | 3/1979 | Stumpp | 123/119 A |
| 4,157,081 | 6/1979 | Wake et al. | 123/119 A |
| 4,192,267 | 3/1980 | Cobb | 123/119 A |
| 4,195,708 | 4/1980 | May et al. | 123/119 A |

*Primary Examiner*—Wendell E. Burns

[57] ABSTRACT

An engine system includes a compression ignition engine having exhaust gas recirculation controlled by a valve and supplied with fuel by a pumping apparatus. The valve is controlled by an operator including a spring loaded piston. The pressure of fluid applied to the piston is controlled by a spring loaded piston and the force applied by the spring is controlled in accordance with the setting of a fuel control member which controls the fuel supplied to the engine by the apparatus. In a preferred arrangement the fuel control member is a throttle and valve means the setting of which is responsive to the throttle position, and is provided for controlling a fluid pressure applied to the piston in opposition to the spring.

6 Claims, 9 Drawing Figures

ENGINE SYSTEM

This invention relates to an engine system including a compression ignition engine, a fuel pumping apparatus for supplying fuel in timed relationship to the combustion chambers of the engine, a fuel control member forming part of the apparatus and adjustable to control the amount of fuel supplied by the apparatus at each delivery stroke thereof, an air inlet and an exhaust gas outlet on the engine and valve means operable to permit exhaust gas from the outlet to pass to the inlet.

The purpose of allowing exhaust gas to flow into the air inlet of the engine is to reduce the noxious gas content of the exhaust gases. This technique is well known in the art. However, it is necessary to carefully control the level of exhaust gas recirculation. In general the amount of exhaust gas recirculated should decrease as the load on the engine is increased.

The object of the invention is to provide an engine system of the kind specified in a simple and convenient form.

According to the invention, in a system of the kind specified said valve means includes a valve member and the system includes a valve actuator for moving said valve member between an open and a closed position, the valve actuator comprising a pressure responsive member which is resiliently biassed to a position in which the valve member assumes the closed position, pump means for supplying fluid under pressure, a piston located within a cylinder, resilient means biassing the piston towards one end of the cylinder, orifice means defined in the piston and cylinder for controlling the fluid pressure at the other end of the cylinder whereby the force developed by the fluid pressure acting on the end of the piston at the one end of the cylinder is balanced by the force due to the resilient means and the fluid pressure acting on the other end of the piston, conduit means through which the fluid pressure at the other end of the cylinder is applied to the pressure responsive member of the actuator, and means responsive to the setting of the fuel control member for varying the force exerted by the resilient means.

One example of a system in accordance with the invention will now be described with reference to the accompanying drawings in which.

Figure 1:
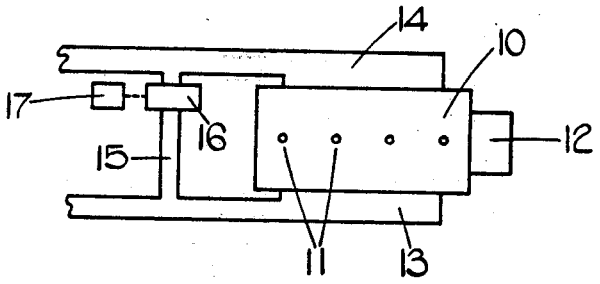
FIG. 1 is a diagrammatic view of the engine installation.

Referring to FIG. 1 of the drawings, there is illustrated a compression ignition engine 10 having fuel injectors 11 which are supplied with fuel by way of pipelines (not shown), by a fuel injection pumping apparatus 12 which is driven in timed relationship with the engine. The engine has an exhaust manifold 13 and an air inlet manifold 14, the latter in use, drawing air from the atmosphere through a filter. The exhaust manifold is connected to a branch pipe 15 which connects with the air inlet manifold by way of valves means 16, the setting of which is determined by a valve operator 17. In use, when a valve member in the valve means 16 is opened, exhaust gas from the exhaust manifold can flow past the aforesaid valve member into the stream of air being drawn into the air inlet manifold.

The supply of exhaust gas to the air inlet manifold is well known in the art and an engine fitted with this arrangement is said to have exhaust gas recirculation. The purpose of exhaust gas recirculation is to reduce the level of noxious gases in the exhaust gases which are discharged to the atmosphere.

With a compression ignition engine it is found that the relative amount of exhaust gas to clean air should be increased as the load on the associated engine decreases and an indication of the load on the engine is obtained by the amount of fuel which is supplied to the engine by the fuel pumping apparatus.

Figure 2:
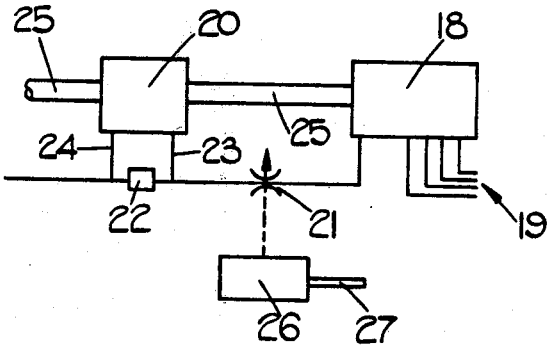
FIG. 2 is a diagrammatic view of the fuel pump.

In FIG. 2 there is illustrated in block form, the fuel pumping apparatus 12 and it will be seen to comprise an injection pump 18 having fuel outlets collectively indicated at 19 for connection to the injection nozzles 11 respectively. The injection pump 18 is supplied with fuel by a low pressure supply pump 20 by way of a fuel control member in the form of an adjustable throttle 21. The outlet pressure of the supply pump 20 is controlled by a valve 22 which spills fuel between the outlet 23 and the inlet 24 of the fuel supply pump. The inlet 24 of the pump is connected to a source of fuel for example, a fuel tank, the connection to the fuel tank being effected by way of a filter as is well known in the art. The valve 22 is so constructed that the pressure at the outlet 23 of the pump varies in accordance with the speed at which the apparatus is driven. It will be noted that the supply pump 20 and injection pump 18 are shown to be coupled by means of a shaft 25 which is connected to a suitable drive member on the engine.

The setting of the throttle 21 which provides an indication of the load, is determined by a governor mechanism 26. The governor mechanism is responsive to the speed of the associated engine and this may be effected by incorporating in it a member which is responsive to the outlet pressure of the supply pump 20 or it may incorporate a centrifugal mechanism which for convenience, is mounted on the shaft 25. The governor mechanism will, however, include an operator adjustable member which is indicated at 27 and which can be moved by the operator to control the speed of operation of the associated engine. If the member 27 is moved to increase the speed of the engine then the restriction to the flow of fuel offered by the throttle 21 will be decreased and vice versa. The governor mechanism may be what is termed in the art an "all-speed" governor or it may be a "two-speed" governor.

Figure 3:
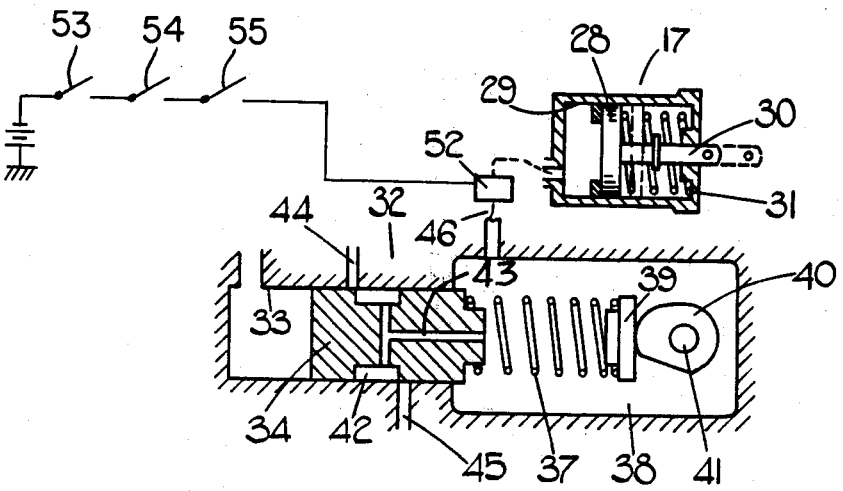
FIG. 3 is a part-sectional side elevation of part of the fuel pump.
Figure 4:
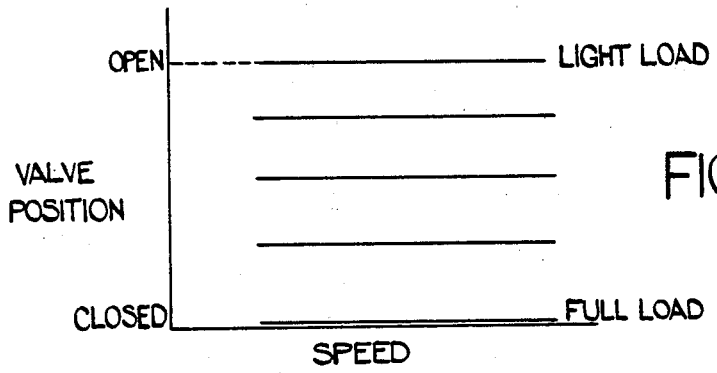
FIGS. 4, 5, 6 and 7 are graphs demonstrating the operation of the system.

Turning now to FIGS. 3 and 4, there is seen in FIG. 3 the valve actuator 17 which will be seen to comprise a pressure responsive member in the form of a piston 28 housed within a cylinder 29. The piston has a piston rod 30 connected thereto which is connected to the valve member of the valve means 16. Moreover, the piston is biased by resilient means in the form of a coiled compression spring 31, to a position in which the valve member of the valve means 16 is closed.

Also shown in FIG. 3, is a valve unit generally indicated at 32, for determining the pressure which is applied to the piston 28.

The valve unit 32 comprises a cylinder 33 in which is located a piston 34 which is biased towards one end of the cylinder by means of a coiled compression spring 37 housed within a spring chamber 38 constituting an extension of the other end of the cylinder 33. The one end of the cylinder communicates with the outlet of the supply pump 20. The spring 37 remote from the piston 34 is mounted upon an abutment 39 and the position of the abutment 39 can be controlled by a cam 40. The cam 40, as shown in FIG. 3, is mounted on a shaft 41 and this is connected by linkage (not shown) to the adjustable throttle 21. The arrangement of the linkage and the cam 40 is such that as the effective size of the throttle is reduced, the abutment 39 is moved away from the one end of the cylinder 33 thereby reducing the force exerted by the spring 37 on the piston 34.

The piston 34 is provided with a circumferential groove 42 which communicates by way of a cross drilling and an axial drilling 43 in the piston, with the aforesaid spring chamber 38. Formed in the wall of the cylinder 33 are a pair of spaced ports 44, 45, the port 44 communicating with a drain whilst the port 45 communicates with the outlet 23 of the supply pump 20. In addition, the spring chamber 38 is connected by way of a conduit 46 with the end of the cylinder 29 remote from the spring 31.

In operation, the pressure in the spring chamber 38 is dependent upon the force exerted by the spring 37 upon the piston 34 and also the pressure in the one end of the cylinder 33. Assuming for the moment that the pressure is constant then as the force exerted by the spring is reduced, the piston will move towards the right thereby allowing fluid flow through the port 45 into the spring chamber 38. As a result the pressure in the spring chamber 38 will rise and this will act upon the piston which will move to cover the port 45. Conversely if the force exerted by the spring should fall the piston will move towards the left to allow fluid to flow from the spring chamber through the port 44 thereby resulting in a lowering of the pressure in the spring chamber. The pressure in the spring chamber 38 is applied to the piston 28 and as a result with increasing pressure in the spring chamber the piston will move towards the right increasing the amount of exhaust gas recirculation and vice versa. Thus increasing the force exerted by the spring 37 reduces the exhaust gas recirculation and vice versa.

The cam is arranged and is coupled to the fuel control member so that as the fuel control member is moved to increase the amount of fuel supplied to the engine i.e. to increase the load on the engine, the force exerted by the spring 37 is increased and vice versa. Again assuming that the fluid pressure supplied to the aforesaid one end of the cylinder remains constant the curves shown in FIG. 4 will be obtained. These curves approach the ideal and such an arrangement can be used where for a given setting of the fuel control member the amount of fuel delivered at each injection stroke of the injection pump remains substantially constant throughout the speed range.

In the case where the fuel control member is a throttle as is described, this does not apply and for a given setting of the throttle as the speed of the associated engine increases the amount of fuel supplied at each injection stroke will decrease because of the reduced time available for fuel flow. However, the setting of the throttle is controlled by a governor and the tendency is for the throttle to be opened as the engine speed increases to counteract the effect described. As the setting of the throttle varies so also does the degree of exhaust gas recirculation and the result would be that for a constant light load the degree of exhaust gas recirculation would fall with increasing speed.

Figure 5:
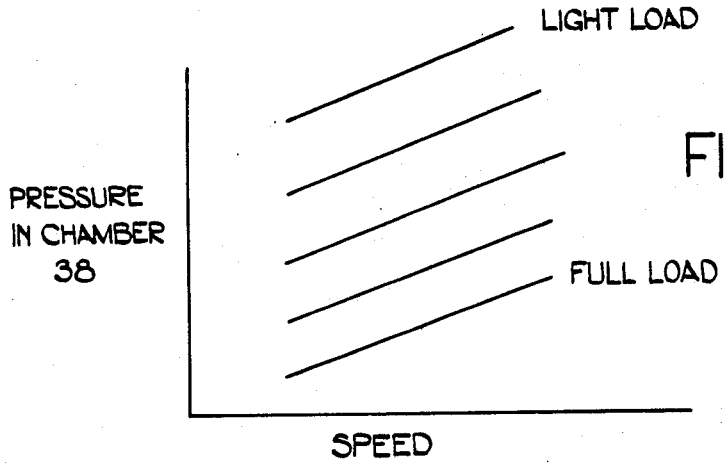

The fact that the pressure of fluid applied to the aforesaid one end of the cylinder 33 varies in accordance with speed counteracts the above effect. FIG. 5 shows how the pressure in the spring chamber 38 varies with speed assuming that the control member position does not vary with speed. It will be seen that the pressure in the chamber 38 increases with speed and therefore the valve 16 will tend to open with increasing speed.

When the fuel control member is a throttle the rising characteristic shown in FIG. 5 is to an extent, compensated by the fact that with increasing speed for a given load the throttle is opened thereby increasing the force exerted by the spring 37 and so the variation of the setting of the valve 16 with load and speed will be more like the variation shown in FIG. 4. The resultant characteristic may be suitable for some engines.

Figure 6:
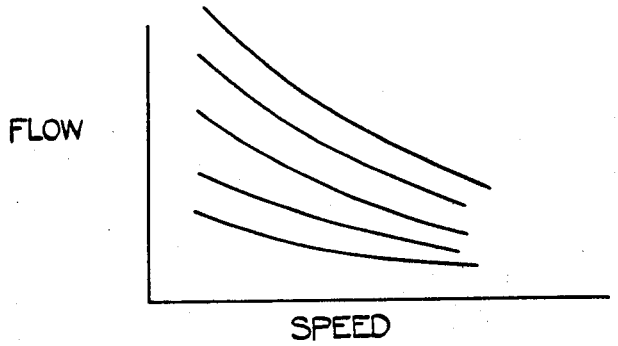
Figure 7:
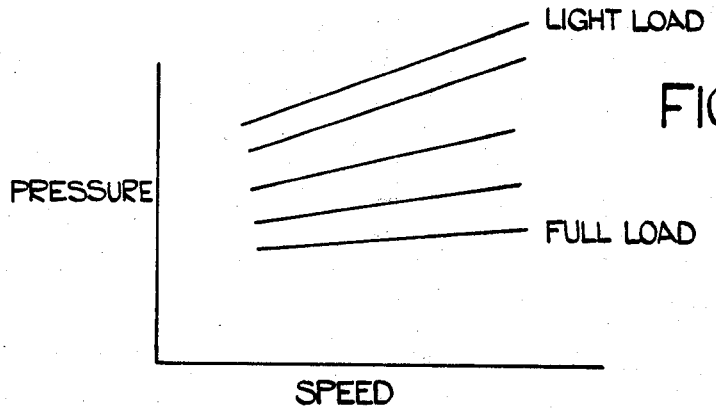

In practice, however, the flow through the throttle 21 for various fixed settings of the throttle is as seen in FIG. 6. The various curves converge with increasing speed, the point of convergence being outside the speed range of the engine. In order to provide more accurate compensation it is therefore necessary for the pressure in the aforesaid one end of the cylinder 33 to be varied also in accordance with the setting of the throttle. For this purpose a fluid pressure control means is utilized which is coupled to the throttle. Before describing the practical embodiments of the control means the effect produced by the control means will be described with reference to FIG. 7. This figure is similar to FIG. 4 but it shows that the curves obtained at various throttle settings diverge with increasing speed. Thus more effective compensation is obtained.

Figure 8:
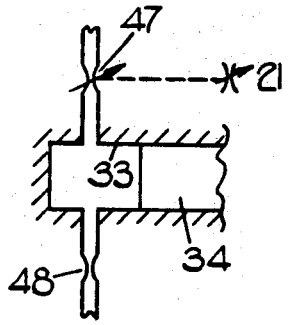
FIG. 8 shows a modification to part of the pump seen in FIG. 3.
Figure 9:
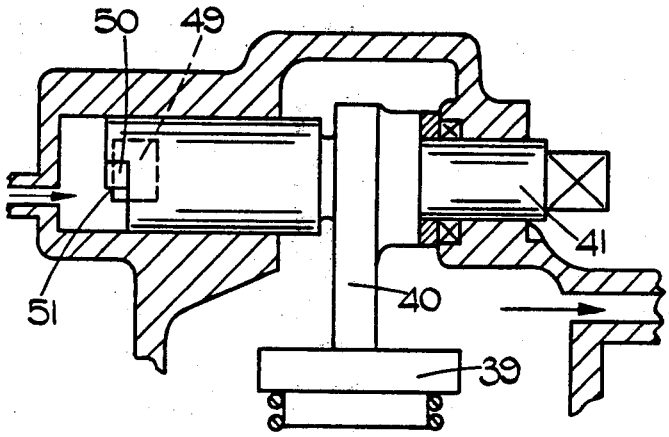
FIG. 9 shows a view at right angles and to an enlarged scale of the part of the pump seen in FIG. 3 when the modification of FIG. 9 is incorporated.

One example of the control means is seen in FIG. 8. A pair of restrictors 47, 48 communicate with the cylinder 33, the restrictor 47 serving to permit fluid to enter the cylinder from the outlet 23 of the supply pump and being variable in accordance with the setting of the throttle 21. The restrictor 48 communicates with a drain and as the throttle is varied the pressure in the one end of the cylinder 33 varies. In practice the degree of restriction afforded by the restrictor 47 is reduced as the throttle 21 is closed, thus giving the characteristics shown in FIG. 7. A similar effect may be obtained by varying the restrictor 48 instead of the restrictor 47 but in this case the variation of the restrictor must be in the opposite sense. If desired, however, both restrictors may be varied.

The restrictor 47 is constituted by a rectangular port 49 which is formed in the wall of a bore accommodating an enlarged portion of the shaft 41. The end of this shaft is provided with a recess 50 which defines a sharp edge 51 which as the shaft is moved, sweeps across the port 49.

The recirculation of exhaust gas should only take place when the engine has attained its desired operating temperature and for this purpose a valve 52 is disposed in the conduit 46. This valve is an electromagnetic valve which when energised permits fluid pressure to be applied to the piston 28. When de-energised the cylinder 29 is connected to a drain so that the spring 31 is able to move the piston to the position in which no exhaust gas recirculation takes place. A switch 53 is provided which is closed when the engine temperature reaches its correct value. In addition two further switches 54 and 55 are connected in series with the aforesaid switch 53 one of which opens when the engine speed falls to idling speed and the other of which opens when the engine speed exceeds a predetermined value. Thus exhaust gas recirculation is obtained only when the engine has reached its normal operating temperature and when its speed lies between upper and lower limits.

I claim:

1. An engine system including a compression ignition engine, a fuel pumping apparatus for supplying fuel in timed relationship to the combustion chambers of the engine, a fuel control member forming part of the apparatus and adjustable to control the amount of fuel supplied by the apparatus at each delivery stroke thereof, an air inlet and an exhaust gas outlet on the engine, valve means operable to permit exhaust gas from the outlet to pass to the inlet, said valve means including a valve member and the system including a valve actuator for moving said valve member between an open and a closed position, the valve actuator comprising a pressure responsive member which is resiliently biassed to a position in which the valve member assumes the closed position, pump means for supplying fluid under pressure, a piston located within a cylinder, conduit means connecting one end of said cylinder to said pump means, resilient means biassing the piston towards said one end of the cylinder, orifice means defined in the piston and cylinder for controlling the fluid pressure at the other end of the cylinder whereby the force developed by the fluid pressure acting on the end of the piston at the one end of the cylinder is balanced by the force due to the resilient means and the fluid pressure acting on the other end of the piston, further conduit means through which the fluid at the other end of the cylinder is applied to the pressure responsive member of the actuator, and means responsive to the setting of the fuel control member for varying the force exerted by the resilient means.

2. An engine system according to claim 1 in which said fuel control member comprises a throttle member and the system includes valve means coupled to said throttle member, said valve means acting to vary the pressure of fluid supplied to said one end of the cylinder in accordance with the setting of said throttle member.

3. An engine system according to claim 2 in which said pump means comprises a low pressure fuel pump forming part of the apparatus, the apparatus including a relief valve operable to control the output pressure of the low pressure fuel pump, so that it varies in accordance with the speed of the engine.

4. An engine system according to claim 3 in which said valve means is located in a passage connecting the outlet of the low pressure pump with the one end of the cylinder.

5. An engine system according to claim 4 including further valve means in said further conduit means, said further valve means being operable to prevent the application of fluid pressure to said pressure responsive member when the engine speed is outside a predetermined range.

6. An engine system according to claim 5 in which said further valve means is responsive to the temperature of the engine.

* * * * *